US006423113B1

(12) United States Patent
Ayers et al.

(10) Patent No.: US 6,423,113 B1
(45) Date of Patent: Jul. 23, 2002

(54) CONTINUOUS FLUID ATOMIZATION OF MATERIALS IN A RAPIDLY SPINNING CUP

(75) Inventors: Jack Ayers, Oakton; Khershed P. Cooper, Fairfax, both of VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 964 days.

(21) Appl. No.: 08/673,762

(22) Filed: Jun. 14, 1996

(51) Int. Cl.[7] ..... B22F 9/06; B22F 9/08; B22F 9/10; B22F 9/14

(52) U.S. Cl. ..... 75/338; 75/331; 75/333; 75/334; 75/339; 75/340

(58) Field of Search ..... 75/338, 331, 333, 75/334, 339, 340; 425/8; 264/8

(56) References Cited

U.S. PATENT DOCUMENTS 4,025,249 A * 5/1977 King ..... 425/6
4,217,082 A * 8/1980 Bourdeau ..... 425/8
4,310,292 A * 1/1982 Carlson et al. ..... 425/8
4,419,061 A * 12/1983 Patterson, II ..... 425/8

* cited by examiner

*Primary Examiner*—M. Alexandra Elve
(74) *Attorney, Agent, or Firm*—John J. Karasek; George A. Kap

(57) ABSTRACT

Fine powders are made from molten metals and alloys on a continuous basis. A rapidly spinning shallow cup has an atomizing fluid such as water, oil or any other hydrocarbon supplied to the cup to form a thin sheet or layer which is distributed on the inner surface of the cup. Within the cup a stream or spray of molten metal is propelled into this thin sheet of atomizing fluid. The metal interacts with the atomizing fluid film and is fragmented or broken down into many small droplets which are quenched by the atomizing fluid and solidified into fine powder. These powders in the form of a slurry with the atomizing fluid can be continuously removed as the slurry discharges up over the lip of the cup by centrifugal force and the powders can be recovered. In a preferred embodiment a preatomizer is positioned between the incoming stream of molten metal and the spinning cup. This breaks up the molten stream into a series of droplets that will be directed to the atomizing liquid film on the inner wall of the spinning cup so that even finer particles will be produced.

36 Claims, 7 Drawing Sheets

CONTINUOUS FLUID ATOMIZATION OF MATERIALS IN A RAPIDLY SPINNING CUP

BACKGROUND OF THE INVENTION

1. Field of the Invention

This invention relates to a method and apparatus for the atomization of fluids in rapidly spinning cup.

2. Description of the Previously Published Art

Powdered metals of fine sizes are required for many applications, and for some of these applications it is desirable that the mean size of the particles be less than 20 micrometers, sometimes even substantially less than this value. There are many processes for making metal powders, but those of greatest interest are those which atomize (i.e. fragment) a molten metal. Atomization processes are preferred over other methods because the powder particles can then have compositions identical to that of the melt from which they were formed, whereas many other types of processes are more restricted in the range of compositions they can produce, and they are generally more costly than atomization.

There are many different atomization processes, of which the most widely practiced are gas atomization and water atomization. Gas atomization can be done in many different ways, but all of them consist of fragmenting a stream of molten metal by causing it to interact with jets of gas flowing from one or more nozzles. Water atomization consists of fragmenting a stream of molten metal by causing it to interact with water ejected at high speed from one or more nozzles. Metal powders are also produced by oil atomization, which is identical in principle to water atomization, but which, under similar operating conditions, produces coarser powder than water atomization. The reason for this is that oils are more viscous than water and thus they exit from the nozzles at lower speeds than does water. Thus the oil streams are less energetic than water and hence less able to fragment the molten metal.

U.S. Pat. No. 4,394,332 to Raman et al at Battelle discloses one method to accelerate oil (and other fluids) to high speed so as to make it an effective atomizing medium. This method consists of containing a limited volume of atomizing fluid within a rimmed cup and spinning the cup at high speed about its central axis. This method is called the Rapidly Spinning Cup or RSC process. Molten metal is dripped or injected into the rapidly spinning fluid and is atomized by it. This method can produce fine powders and the powders can have desirable properties such as low levels of contamination, but the method suffers from the disadvantage of producing only limited amounts of powder.

This disadvantage is because the Raman et al process is a batch process. The amount of powder which can be produced is limited by the volume of fluid which can be contained by the cup. The volume of powder generated must be substantially less than the volume of atomizing fluid so as to prevent overheating of the fluid, so even with large spinning cups the weight of powder produced could not reasonably exceed a few tens or hundreds of pounds.

U.S. Pat. No. 4,405,535 to Raman et al at Battelle discloses two further variations of the rapidly spinning cup embodiment. In FIG. 1 the RSC is essentially the same as in U.S. Pat. No. 4,394,332 discussed above. The change is in the manner by which the molten metal is added. In the '332 patent the apparatus is a crucibleless device because the metal is in the form of a solid bar. The end inside the spinning cup is heated so the metal at that tip end melts and drips into the RSC. In the '535 patent a vessel with a surrounding heating means serves as a crucible which provides the molten metal supply. This device in FIG. 1 is only suitable for operation as a batch process.

The embodiment in FIG. 2 is an attempt to devise a continuous process. Prior art processes were not continuous because they used a fixed volume of oil contained within the cup. The powder also accumulated within the cup and displaced part of the oil, so that the volume of oil actually decreased with time. The amount of melt was restricted to a volume substantially less than that of the oil, because of the heat transferred from the melt to the oil.

U.S. Pat. No. 4,405,535 in FIG. 2 seeks to overcome this by permitting oil to exit from the side of the cup. A hole is made in the side of the wall of the spinning cup to permit the quench fluid and formed particulates to flow from the cup when the process is in operation. The quench liquid is cooled and recirculated back into the RSC. The size of the hole is kept small enough that in relation to the speed of rotation of the cup and the pump capacity of the pump an adequate supply of quench fluid is maintained in the cup. This, however, is an ineffective approach because it does not provide an efficient means for the constantly added oil to flush powder from the cup. With a single hole on the cup perimeter as shown in the patent, or even with a multiple of holes, the powder will accumulate on the inner vertical wall of the cup and be held there by centrifugal force.

A later article by Erich et al "Battelle Plan Commercialisation of Two-Stage Spinning Cup Atomisation Process" Metal Powder Report, Vol. 42, No. Oct. 10, 1987 pg. 698–700, discloses two types of spinning cup atomizations. The single stage RSC is illustrated in FIG. 1 herein and consists of a rotating cup with a liquid quenchant. Under the action of centrifugal forces, the liquid forms a layer on the walls of the cup during rotation. A stream of molten metal to be atomized is directed onto the rotating quenchant where it is sheared and pulverized into small droplets. The two stage process has the primary liquid metal stream disintegrated into fine ligaments or large liquid metal droplets by low pressure gas or conventional centrifugal atomization. Thus the molten metal is broken up into droplets before contacting the atomizing fluid in the spinning cup. However, here again the process is only a batch process.

Additional research on the RSC process has been conducted at the Naval Research Laboratory. Ayers et al in "Counter Rotating Fluid Atomization of Tin" 2nd International Conference on Rapidly Solidified Materials, March 7–0 1988, disclose an atomization process which combines the rapidly spinning cup process with a centrifugal atomization. The atomizer is positioned within a rapidly spinning cup that rotates in the opposite direction. The fine streams of molten metal which issue from the inner cup strike the fluid contained within the outer cup and they are atomized and quenched by it. The outer cup has a rim which prevents the melt from spinning over the top. Again this is a batch process.

Cooper et al in "Counter Rotating Fluid Atomization" International Journal of Powder Metallurgy, Vol. 28, No. 3, 1993, pg 215–226, disclose studies made on atomization of molten streams of tin injected into rapidly moving oil contained with the rim of a spinning cup. The method consisted of forcing the melt by centrifugal force through fine orifices on the perimeter of a rotating cup centered within the oil-containing cup. The two cups were counter rotating. The powder is recovered from the quench fluid by first lowering the speed of the outer cup to about 200 rpm and raising the cover of the vacuum vessel, thereby removing the inner cup. Most of the oil is then carefully pipetted off, leaving the remaining oil and the powder held against the wall of the spinning cup. This powder/oil slurry is then recovered by pipetting with the thin oil layer being replenished repeatedly with kerosene to assure full recovery, of the powder. After complete removal of the oils using appropriate solvents, the powder is subjected to size analysis. Clearly this is a batch process.

Cooper at al in "Evaluation of Atomization by the Rapidly Spinning Cup Process" International Journal of Powder-Metallurgy, Vol. 30, No. 1, 1994, pg 77–89, disclose a parametric study of the atomization of molten tin injected into oil contained within the rim of a rapidly spinning cup. The liquid metal was introduced as a stream by ejecting it from a small orifice in a tube using pressurized gas. Because the oil was contained within the rim the process was a batch process.

3. Objects of the Invention

It is an object of this invention to produce fine powders in tonnage quantities.

It is a further object of this invention to provide a Rapidly Spinning Cup (RSC) process which operates in a continuous mode.

It is a further object of this invention to provide a RSC process where the cup can be rotated at higher speeds.

It is a further object of this invention to provide a RSC process where the atomizing liquid is not present in the cup during the beginning of the production run when the cup is being accelerated and during the end of the production run when the cup is being decelerated.

It is a further object of this invention to provide a RSC apparatus which does not need to be designed to accommodate the harmonic vibrations which occur at different frequencies in a spinning vessel which contains a liquid.

It is a further object of this invention to provide a RSC process where the cup can be spun at higher speeds so that it can produce finer size powders.

It is a further object of this invention to provide a RSC process where the cup is spinning at such a high speed that it requires only a thin film of atomizing fluid on the inside of the cup.

These and further objects of the invention will become apparent as the description of the invention proceeds.

SUMMARY OF THE INVENTION

This invention makes possible the production on a semi-continuous basis (that is, in multi-ton lots) of fine powders from molten metals and alloys. The process employs a shallow cup rotating at high speeds. Once the high speeds are obtained an atomizing fluid such as water, oil or any other hydrocarbon is fed to the cup to form a thin sheet or layer which is distributed on the inner surface of the cup and which is accelerated to speeds essentially the same as that of the spinning cup. Within the cup a stream or spray of molten metal is propelled into this thin sheet of atomizing fluid. The metal interacts with the fluid and is fragmented or broken down into many small droplets which are quenched by the atomizing fluid and solidified into fine powder. These powders can be continuously removed and recovered. Because the atomizer can be spun at higher speeds, it can produce finer powders.

A further preferred embodiment is to add a preatomizer between the stream of molten metal and the spinning cup. A mechanical impact preatomizer, for example, has rotating impeller blades which break up the molten stream into a series of droplets that will be directed to the atomizing liquid film on the inner wall of the spinning cup. Other embodiments include the use of a gas atomizer or a centrifugal atomizer.

DESCRIPTION OF THE PREFERRED EMBODIMENTS

Figure 1:
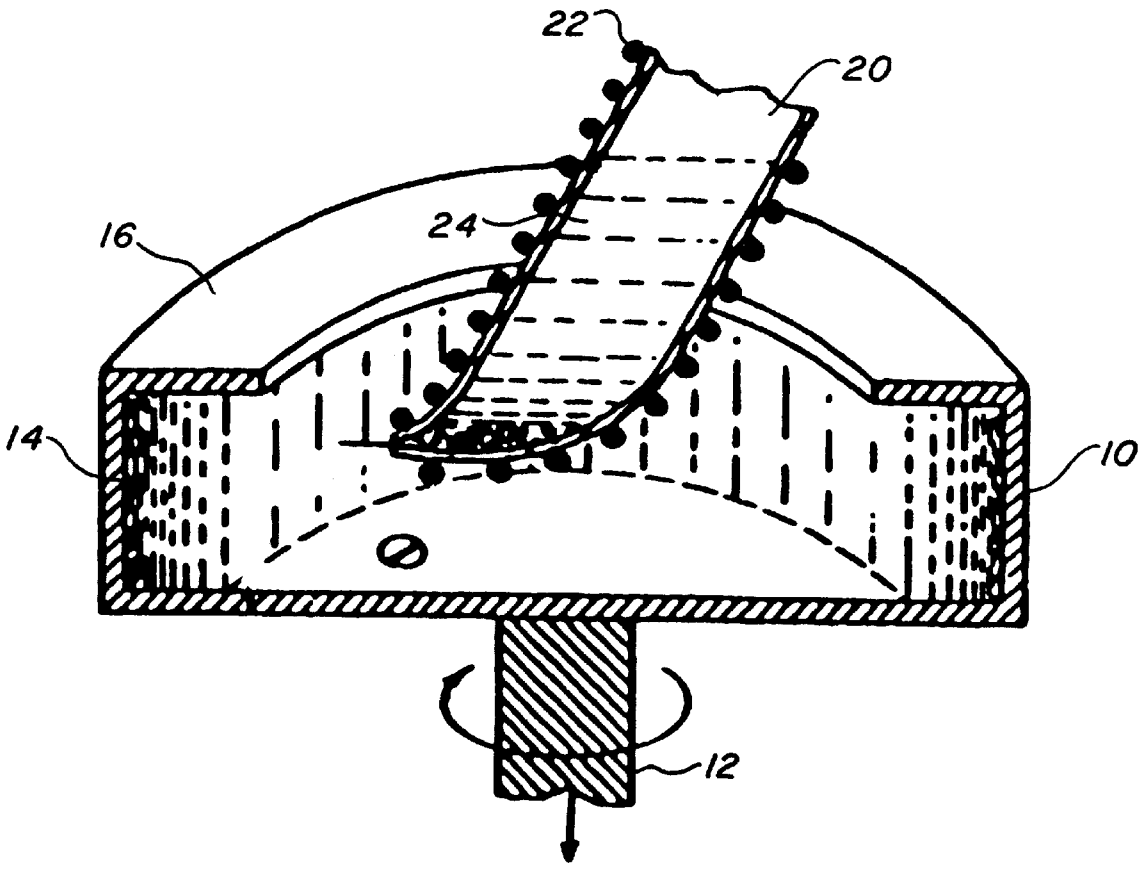
FIG. 1 illustrates a prior art type rapidly spinning cup apparatus.

As discussed above, U.S. Pat. No. 4,405,535 in FIG. 1 and the Battelle Plan article illustrates a rapidly spinning cup (RSC) process with a spinning cup apparatus which is shown here as FIG. 1. The device consists of a spinning cup 10 which is rotated by a shaft 12 connected to drive mechanism which is not shown. When the cup is spinning the liquid quenchant 14 forms a layer on the walls of the cup due to the centrifugal force. On top of the spinning cup is a rim 16 to keep the liquid within the cup. Inserted into the cup is a crucible 20 which is heated by an induction coil 22. This crucible is pressurized and a melt stream is ejected into the spinning cup and into the quenchant liquid where the metal is broken up into fine particles. As discussed above, this process is a batch process which is limited in the amount of powder that can be made in each production run.

Figure 2:
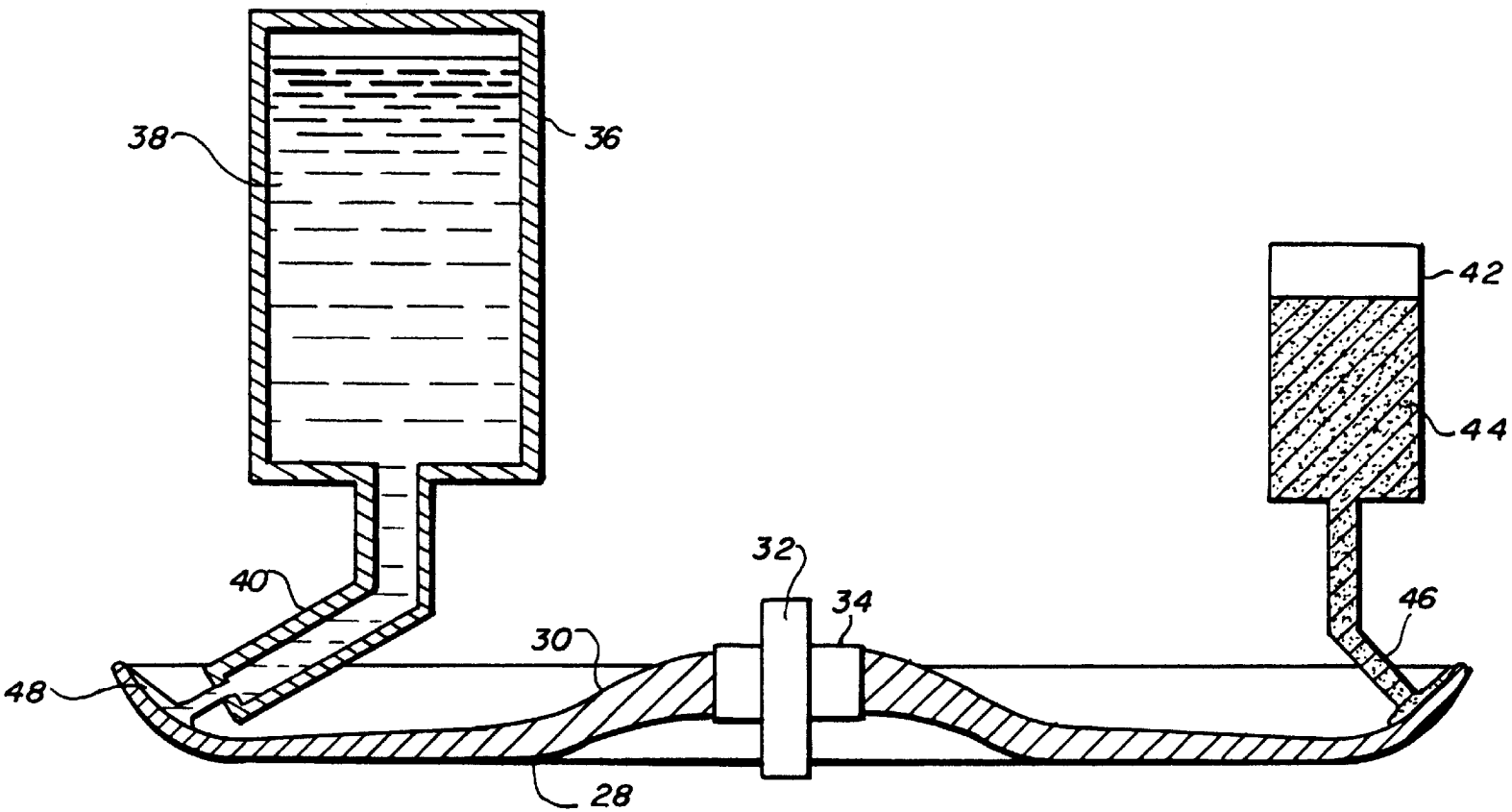
FIG. 2 illustrates a large cup oil atomizer for semicontinuous operation.

An apparatus has been made which permits the production of metal powder by permitting the operation of the rapidly spinning cup process in a continuous manner. FIG. 2 illustrates the novel configuration of a large cup atomizer that permits this continuous operation. A shallow cup 28 having an inner wall 30 is rotated about a shaft 32 which is secured to cup by a bushing 34. The shaft is connected to a drive mechanism which is not shown. An atomizing fluid reservoir 36 which is optionally pressurized supplies an atomizing fluid 38 via feed tube 40 into the cup. A crucible 42, which can be pressurized to a pressure higher than that in the atomizing chamber, contains molten metal 44 and supplies the melt via melt feed tube 46 to be injected into the layer 48 of the atomizing fluid on the inner surface of the cup 32. The layer 48 is shown as a separate, thick layer but it is very small.

During a production operation, the cup can be brought up to the desired spinning speed without any initial fluid being in the cup. Because the cup does not contain any liquid during the time it is being accelerated at the beginning of production run, the apparatus does not need to be designed to accommodate the harmonic vibrations which occur at different frequencies in a spinning vessel containing a volume of liquid. A similar advantage can be obtained by stopping any further flow of the atomizing fluid from the reservoir 36 at the end of the production run so there will be no fluid in the cup when the cup is decelerated.

Once the cup is at the desired speed, atomizing fluid 38 is applied from the feed tube 40 to form a thin coating on the inner wall 30. The molten metal is then delivered from the optionally pressurized melt crucible 42 via feed line 46. The molten metal stream is injected into the rotating layer of atomizing fluid where it is sheared and pulverized into smaller droplets which are then quenched to form fine powder particles.

The resultant slurry of fine metal powder particles in the atomizing fluid is forced upwardly along the sloped inner wall of the cup by centrifugal force. The slurry flows up and over the lip of the cup and discharges from the cup. It is collected outside of the spinning cup for recovery of the liquid which can be subsequently recycled and for recovery of the metal powder particles as the desired product.

By continuously feeding both the atomizing oil or other atomizing fluid and the molten metal, continuous production runs can produce fine powders in tonnage quantities. The new process is superior to the conventional RSC process because the shallow cup can be rotated at higher speeds. These higher speeds are possible because the cup does not need to be built with high strength materials to contain large quantities of atomizing fluid as would be required if one wanted to make a large batch of metal powder in a conventional RSC batch apparatus.

Another reason why large quantities of atomizing fluid are not needed is that at the higher rotating speeds the molten metal does not penetrate as far into the atomizing fluid. Thus the fluid does not need to be as deep as in the conventional RSC process. For this reason, even a thin film of atomizing fluid is sufficient when the cup is spinning at the higher speeds.

The configuration shown in FIG. 2 is only one of the many possible ways to configure the liquid feed sources in the process. In the embodiment illustrated in FIG. 2 the atomizing fluid and the melt are both introduced near the upper edge of the cup below the lip and they are introduced at locations opposite from one another. It may sometimes be advantageous to introduce one or both of the liquids at a position further down from the lip of the cup, and the two liquids may preferably be introduced near one another on the same side of the cup or at other angular positions around the inner perimeter of the cup. The two liquids may also be introduced in other manners than as continuous streams from pressurized containers. Either or both could, for example, be introduced in the form of a spray carried by a gas or distributed by a mechanical atomizer. In the case of a spray atomization nozzle, one could, for example, position a horizontal or nearly horizontal spray atomization nozzle within the rim of the atomizing cup. Although two stage atomization processes have been demonstrated to produce finer powders than single-stage processes, none have previously been constructed which are capable of generating large volumes of powder.

Figure 3:
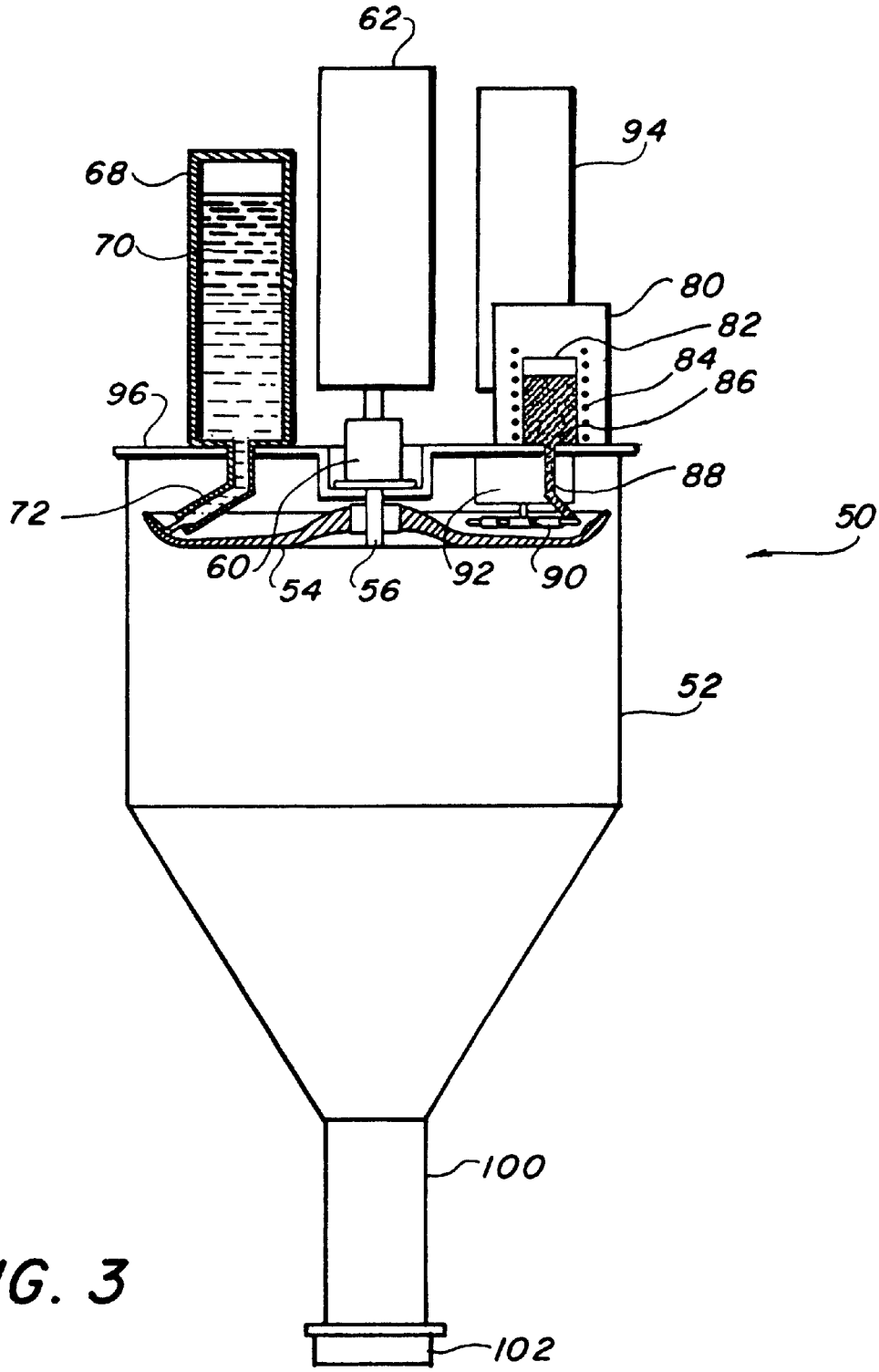
FIG. 3. illustrates a high speed oil atomizer.
Figure 4:
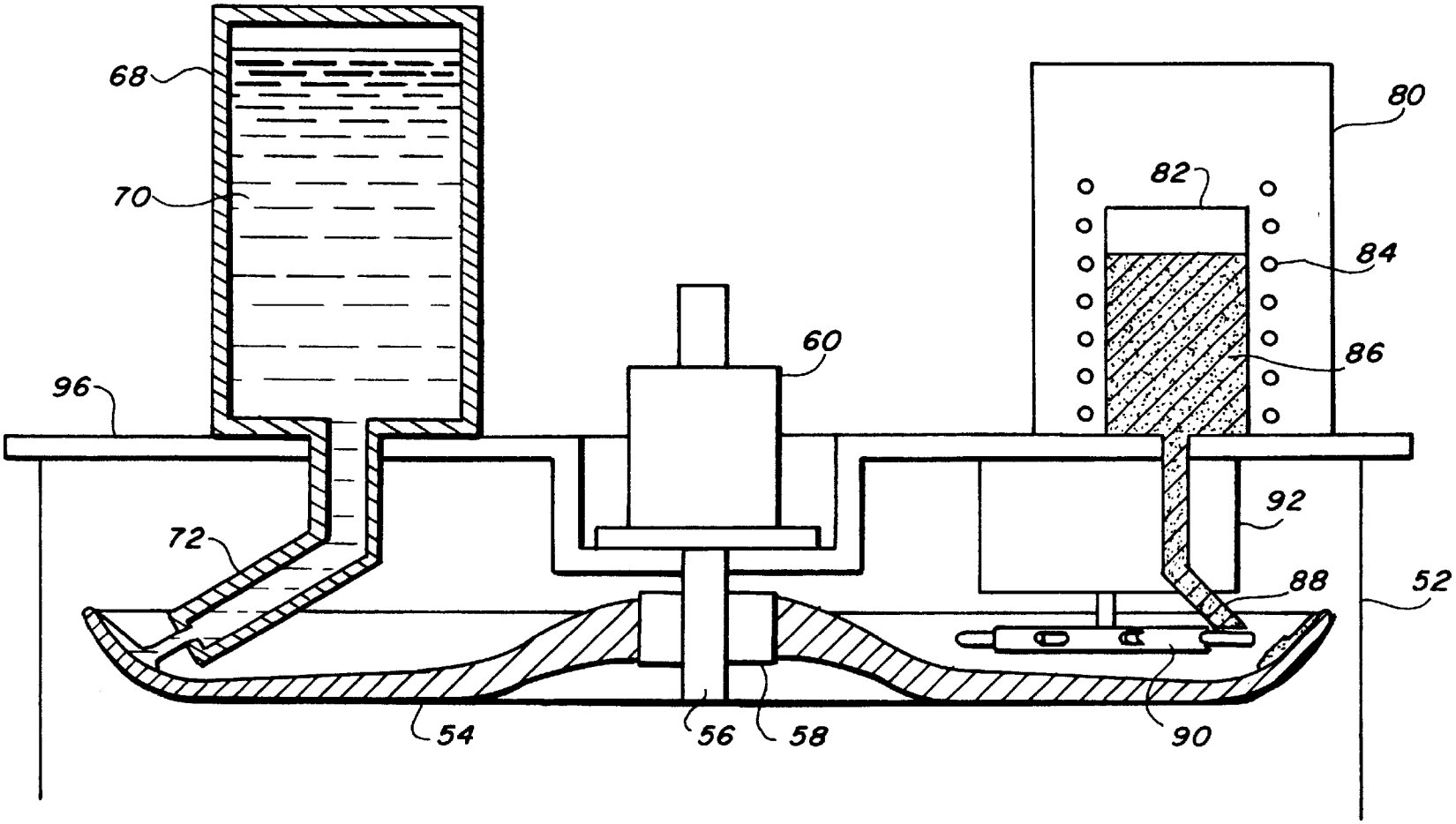
FIG. 4 illustrates a detailed view of the top portion of FIG. 3.

FIG. 3 illustrates a preferred embodiment where a mechanical impact preatomizer is positioned below the melt delivery system. As the melt stream issues from the feed pour tube it is intercepted by a series of impellers. The resulting spray is directed onto the rapidly spinning cup. More specifically, the high speed oil atomizer 50 is made of an operating chamber 52 in which is placed a spinning cup 54 that is rotated about shaft 56 which is secured to the cup by bushing 58 as shown in FIG. 4. This shaft enters the atomizing chamber via rotary motion feedthrough 60 which is driven by motor 62. The optionally pressurized atomizing fluid reservoir 68 provides atomizing fluid 70 through atomizing fluid feed tube 72 to the inner wall of the spinning cup. Angularly displaced around the axis of the atomizer is the melt chamber 80 which has a metal crucible 82 heated by induction coil 84 and containing the melt 86. The melt feed tube 88 supplies the melt into the spinning cup where it strikes an impact atomizer 90 which causes the molten material to break up into fine droplets before it hits the layer of atomizing fluid oh the inner wall of the rapidly spinning cup. The impact atomizer 90 is rotated by a shaft connected via the rotary motion feedthrough 92 by a shaft to the impact atomizer motor 94. The top of the chamber 52 has a cover 96. After the fine particles have been quenched by the atomizing fluid, the slurry flows up and over the lip of the cup into the chamber 52 where the slurry flows down into oil receptacle 100 and the powder is collected in powder receptacle 102 which is a removable canister. The oil receptacle 100 serves to hold the atomizing oil when the apparatus is run in the batch run process. In an atomizer operating in a continuous mode, the receptacles 101 and 102 would be replaced with a system for separating the powder, cooling the oil, and returning the cooled oil to the oil reservoir.

A more detailed view of the upper section of FIG. 3 is shown in FIG. 4 with corresponding parts having the same numbering.

Figure 5:
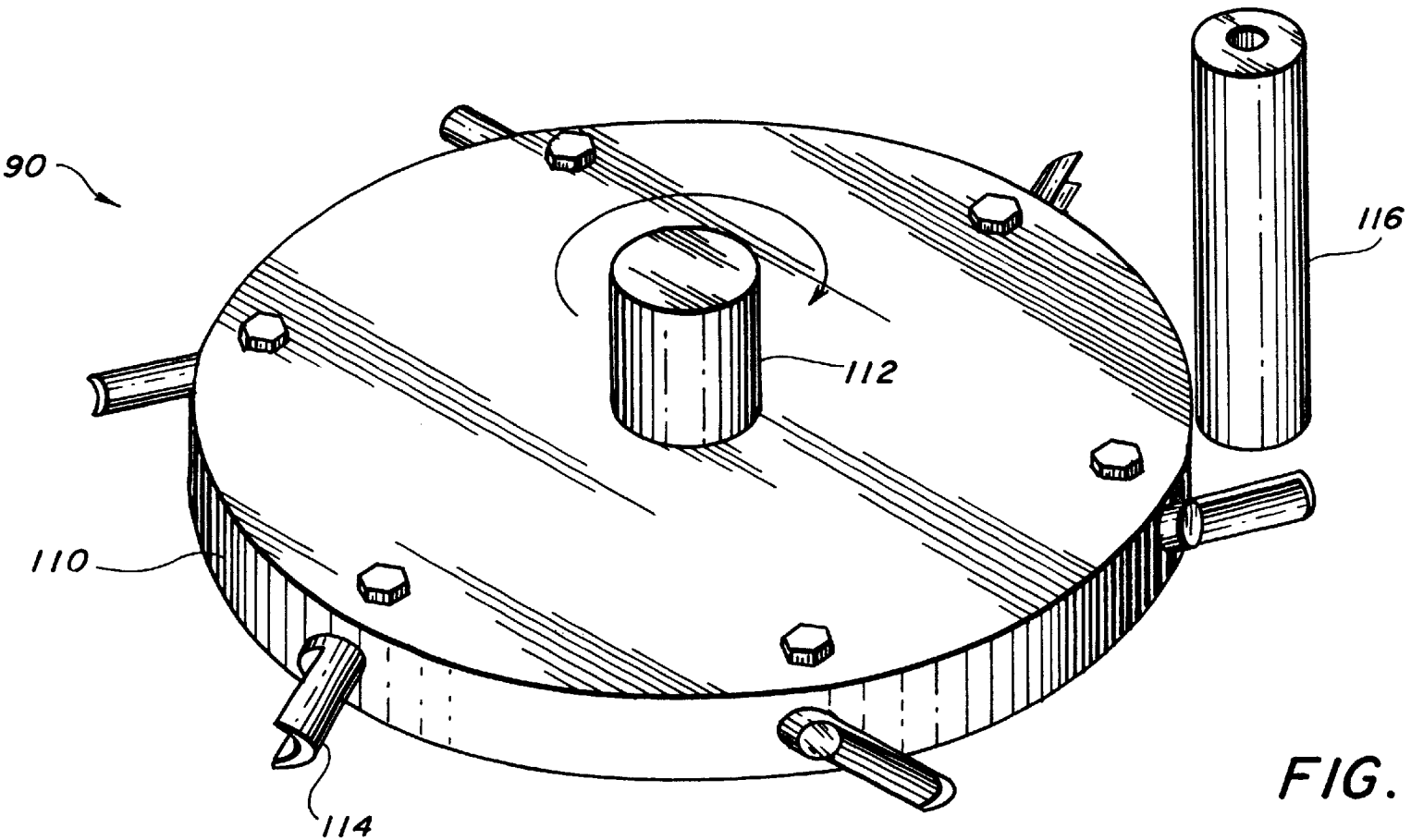
FIG. 5 illustrates an impact preatomizer for use in a spinning cup apparatus.

One possible configuration for a mechanical impact preatomizer is shown in FIG. 5. Here the impact preatomizer 90 has a rotating disk 110 connected by shaft 112 to a motor, not shown. A series of impact impellers 114 extend out from the periphery of the rotating disk. A melt delivery tube 116 is positioned so that as the melt pours from the tube the liquid melt is hit by the rotating impellers or blades 114 and the melt is broken up into a series of particles that will be directed to the film of atomizing liquid on the inner wall of the spinning cup. Many different designs of the impactor are possible to accomplish this function of atomizing the melt before it reaches the inner wall of the spinning cup.

Figure 6:
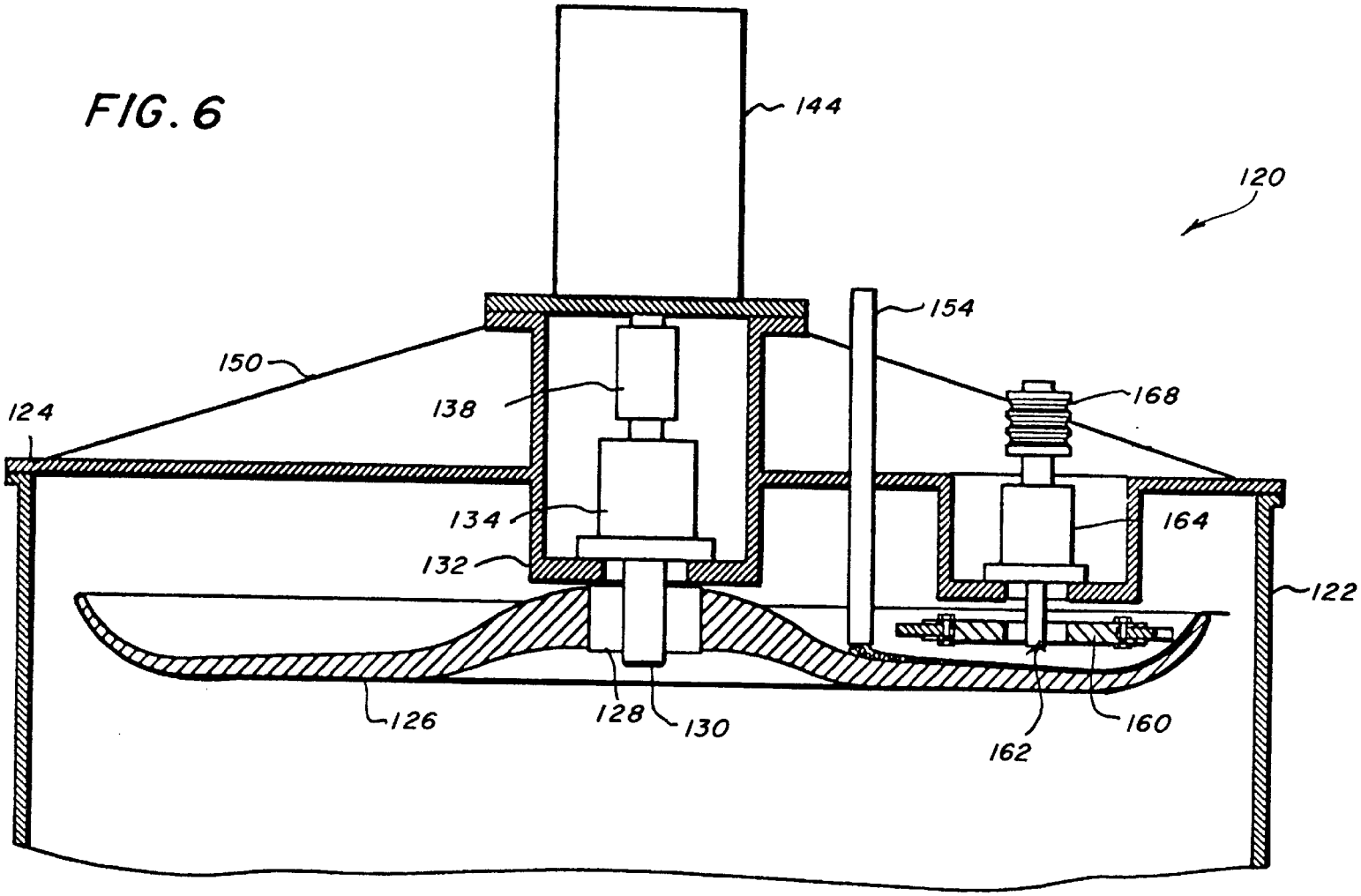
FIG. 6 illustrates a high speed spinning cup atomizer.

A more detailed view of a preferred configuration for the high speed atomizer with a mechanical preatomizer device is shown in FIG. 6 which focuses on the upper section of an operating chamber 122 with a top lid 124. The spinning cup 126 is secured to the shaft 130 by the bushing 128. The shaft enters a housing 132 containing power delivery components. These components area sealed by a ferrofluidic seal 134 whose axial shaft connects to a flexible shaft coupler 138 which in turn is connected to the output shaft of the motor 144 for the spinning cup. On top of the lid 124 is a radial array of top stiffening ribs 150 to provide additional structural support.

An atomizing fluid feed tube 154 supplies the atomizing fluid to the spinning cup. The impact preatomizer 160 is connected via shaft 162 via ferrofluidic seal 164 to pulley 168 which is connected by belts to a motor, not shown, to power the impact atomizer. Again, during operation a melt delivery tube, not shown, is positioned so that as the melt flows out of the tube the melt hits the rotating impeller blades and the melt is broken up into a series of droplets that will be directed to the film of atomizing liquid on the inner wall of the spinning cup.

The atomizing cup which is the central element of this invention can be constructed in many ways and operated in many different system geometries. In general, it is desirable to construct the wheel in a light weight fashion so that it can be readily spun at high speed. A preferred cup has been made of a single piece of high strength aluminum alloy, but higher speeds could be achieved with a cup constructed of light weight composite materials. Because the cup is cooled by the atomizing fluid, it can be made of materials which are sensitive to high temperatures. Examples of such materials are glass or carbon fiber reinforced epoxy.

Figure 7:
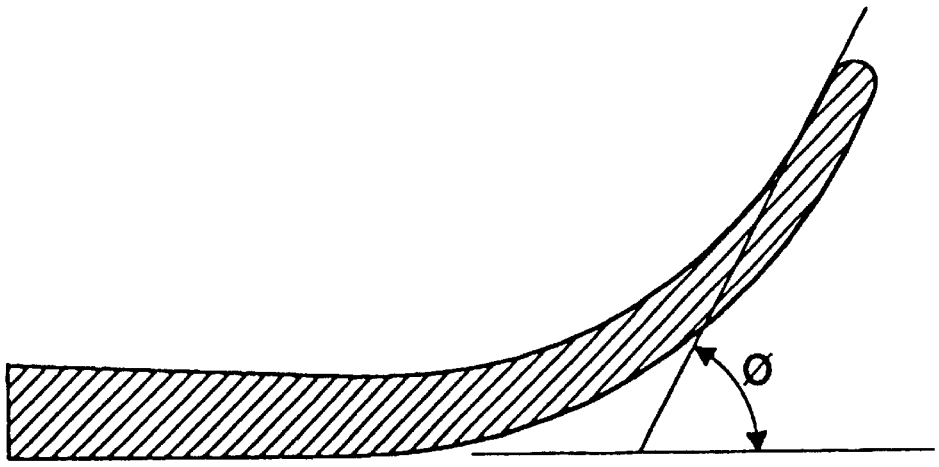
FIG. 7 illustrates how the slope of the cup wall is defined.

It is preferred to have the cup configured so there is sufficient height of the side wall to collect the droplets being formed by the impellers. The more important aspect is the slope of the wall. FIG. 7 illustrates the slope angle $\phi$ (phi) which is the angle between the tangent to the inner wall of the cup at the lip and a line perpendicular to the axis of the cup. This slope $\phi$ is preferably between about 10° and 70°, and more preferably between 30° and 60°. As the slope angle becomes closer to the vertical of 90° the powder will accumulate on the lip and not flow over the top to discharge. As the slope angle becomes progressively lower than about 30°, and especially below 10°, the height of the cup becomes so low that the wall does not collect all of the droplets which are being sent in the direction of the wall when impellers are used for preatomization to form the droplets.

The oil thickness on the spinning cup as a function of rotational velocity and angle of inclination is given by Equation (1)

$$t = \left(\frac{3\mu Q}{2\pi\rho\omega^2 r^2 \cos\Phi}\right)^{1/3} \quad (1)$$

where t=the thickness of the oil film,

Q=the quantity of liquid supply, $\mu$=the oil dynamic viscosity, $\rho$=the oil density, $\omega$=the cup angular speed (=v/r), r=the cup radius, v=the tangential velocity of the cup, and $\Phi$=the angle of inclination of the cup lip from a line perpendicular to the axis of the cup.

Figure 8:
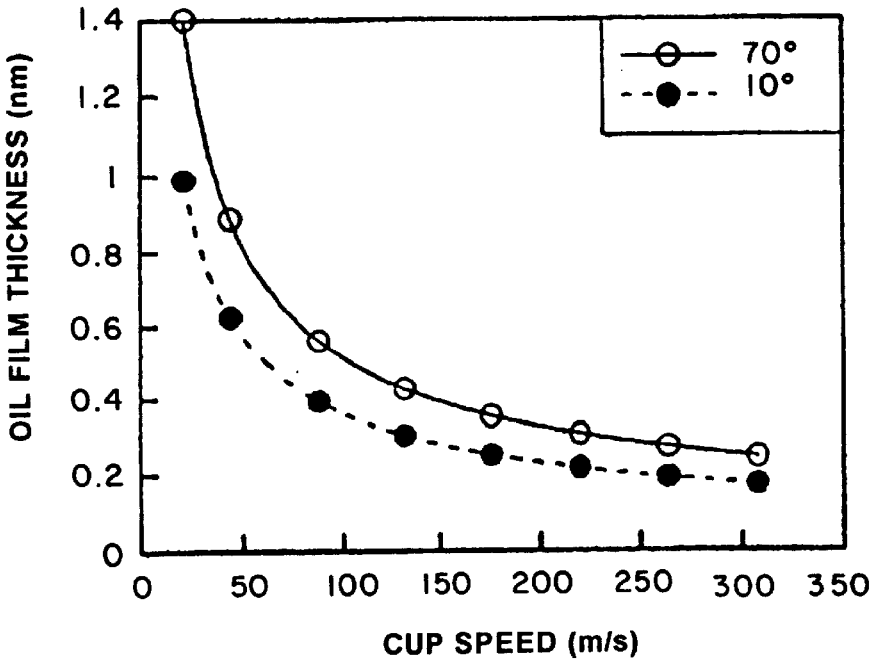
FIG. 8 is a graph of the thickness of the atomizing fluid on the cup wall vs. cup speed.

In the case where Q=325 $cm^3$/sec, the plot of the oil thickness in mm for inclinations, $\Phi$, of 10° and 70° are shown in FIG. 8.

The thickness of the oil film will be quite small and generally less than 3 mm. At higher spinning speeds the thickness can be less than 1 mm.

The cup can be mounted at one end of a thick and relatively stiff shaft as shown in FIG. 6. The mounting shaft protrudes in one direction from the rotary motion feedthrough. This configuration permits the cup to spin about the axis of the shaft and in this configuration the cup should be balanced accurately. The massive, rigid shaft simplifies the problem of keeping the cup in balance when it is loaded nonuniformly, and of limiting harmonic vibration.

The cup can be mounted in either the horizontal configuration as illustrated in the figures or in an inclined configuration.

The atomizing fluid which also serves as a quenchant can be an oil, water, kerosene, alcohol or any other hydrocarbon that does not adversely react with the metal particles.

To prevent oxidation of the molten metal as it solidifies, the chamber surrounding the atomizing apparatus can either be an evacuated chamber which is under vacuum or the chamber can have an inert atmosphere such as argon, helium, or nitrogen. For those metals where is it not harmful, air could alternatively be used.

Because the cup does not need to contain any significant volume of liquid, it can be built in a lightweight manner. A further advantage is that it can be built as large as permitted by the strength of the materials employed so as to attain increased rim velocities. This combination of advantages makes it. easier to generate and maintain a uniform layer of atomizing liquid on the surface of the cup. Large cup sizes (e.g. three feet or more in diameter) also make it easier to engineer efficient melt delivery systems. In the example discussed below, the diameter of the cup is 84 cm. Cups with smaller sizes will make melt delivery difficult to design. Larger sizes can be used especially for increased production and for ease of melt delivery. However, design considerations come into play and appropriate safety features must be utilized as precaution in case the larger disks rupture at the higher speeds.

The rotation speed of the cup can be varied. For the production of fine particles it is preferred to have inner wall cup velocities of at least 75 m/s. For a cup with a diameter of 84 cm, good results have been obtained operating at about 2,000 rpm which is at a velocity of 88 m/s. With cups made of the adequate strength materials, higher speeds such as 7,000 rpm could be used which would correspond to a velocity of about 300 at a measured rate of 325 $cm^3$/sec and the flow rate of the melted tin was calculated as 15 $cm^3$/sec.

The area distribution by average diameter of the particles produced is obtained by controlled scanning electron microscopy (CCSEM). This CCSEM is a size analysis technique that measures the projected area of 10,000 dispersed particles from the powder sample. The results are given in Table 1.

TABLE 1

| Size Fraction in microns | Area Percent |
|---|---|
| −10 | 9 |
| +10 −20 | 25 |
| +20 −30 | 31 |
| +30 −40 | 18 |
| +40 −50 | 12 |
| +50 −60 | 3 |
| +60 −70 | 2 |
| +70 −80 | 1 |
| +80 | 0 |

The melt tube temperature was lower than desired. The m/s. If coarser powders are desired, then the apparatus could be operated at slower speeds such as 200–500 rpm which would be at speeds of 9–22 m/s.

The shape of the cup and the way in which it is made to rotate in a fixed position can be varied so long as these design features permit two preferred features. First, the cup must be spun at high speeds to permit a layer or film of atomizing fluid to be formed on the surface of the cup so that this liquid can fragment and quench the liquid metal. Second, the slurry of atomizing fluid and solidified powder must be able to be continuously discharged from the cup and be collected in a suitable manner. Preferably, the discharge is over the lip of the cup.

Having described the basic aspects of the invention, the following examples are given to illustrate specific embodiments thereof.

EXAMPLE 1

A two stage atomizer was constructed according to the device illustrated in FIG. 6 as follows. The aluminum cup has a diameter of 84 cm. Once operating conditions are reached the cup has a cup speed of 88 m/sec which is 2,008 rpm. The impeller speed is 28 m/sec (2,092 rpm). The metal is tin and the furnace temperature was 502° C. The temperature in the melt tube is 278° C. The chamber was maintained under vacuum. The atomizing fluid was vacuum pump oil with specific gravity of 0.87 which was supplied particles have a mean size of 27 microns.

EXAMPLE 2

A run was made with the same apparatus and conditions as in

Example 1, except that the temperature in the melt tube was maintained at a higher value of about 500° C. The particle sizes appear finer than the particle size measured in Example 1.

The literature has recognized that higher cup speeds result in finer particles. Erich et al cited above note that in the single stage RSC process the rotating liquid velocity is the most important process variable that influences particle size. They find particle size decreases with increasing quenchant velocity. Similarly, Cooper at al in their 1993 article find that the size distribution shifts towards finer size fractions with increasing outer cup speed and in the 1994 article their FIG. 5 shows a significant decrease in mean particle size occurs with increase in cup speed. Thus, as higher velocities are used with the present improved apparatus, finer particle sizes will be obtained. At speeds of 300 m/s, articles with an average size less than 10 microns should be obtained.

It is understood that the foregoing detailed description is given merely by way of illustration and that many variations may be made therein without departing from the spirit of this invention.

What is claimed is:

1. A rapidly spinning cup molten metal atomizer capable of continuous operation comprising:

cup means having an inner wall designed to permit rapid spinning of said cup and said inner wall having an upper lip with no upper lid;

spinning means for rapidly spinning said cup;

a fluid supply means to apply atomizing fluid to the inner wall of said cup means to form a layer or film of the fluid on the inner wall and the fluid flowing up and over the lip due to the centrifugal force;

molten metal supply means to supply a stream of molten metal to the interior of the rapidly spinning cup means when said cup is rapidly spinning;

directing means to direct the stream of molten metal from the molten metal supply means to the layer or film of atomizing fluid on the inner wall of said cup means whereby the atomizing fluid fragments and quenches the molten metal to form a slurry of atomizing fluid and solidified powdered metal on said inner wall and the slurry flows up and over the lid to discharge from the cup; and recovery means to collect the continuously discharged slurry of atomizing fluid and solidified powdered metal from the cup.

2. A rapidly spinning cup molten metal atomizer according to claim 1, further comprising means to separate the powdered metal and the atomizing fluid.

3. A rapidly spinning cup molten metal atomizer according to claim 2, further comprising means to recycle the atomizing fluid to the fluid supply means.

4. A rapidly spinning cup molten metal atomizer according to claim 1, wherein the lip on the cup means is inclined upward from the plane constituting the base of the cup and the degree of inclination is measured by a slope angle $\phi$ which is the angle between the tangent to the inner wall of the cup at the lip and a line perpendicular to the axis of the cup.

5. A rapidly spinning cup molten metal atomizer according to claim 4, wherein the slope angle $\phi$ is from about 10–70°.

6. A rapidly spinning cup molten metal atomizer according to claim 5, wherein the slope angle $\phi$ is from about 30–60°.

7. A rapidly spinning cup molten metal atomizer according to claim 1, further comprising a preatomizer means positioned between the directing means and the inner wall of said cup means to convert the stream of molten metal into droplets.

8. A rapidly spinning cup molten metal atomizer according to claim 7, wherein the inner wall of said cup means has sufficient height to collect the droplets being formed by the preatomizer means.

9. A rapidly spinning cup molten metal atomizer according to claim 7, wherein the preatomizer means is a mechanical impact atomizer.

10. A rapidly spinning cup molten metal atomizer according to claim 7, wherein the preatomizer means is a gas atomizer.

11. A rapidly spinning cup molten metal atomizer according to claim 7, wherein the preatomizer means is a centrifugal atomizer.

12. A rapidly spinning cup molten metal atomizer according to claim 1, wherein the fluid supply means has control means to prevent the supply of fluid to the cup means when the cup means is being accelerated or decelerated.

13. A rapidly spinning cup molten metal atomizer according to claim 1, wherein the cup means is made of a high strength material selected from the group consisting of aluminum alloy,titanium alloy, and glass or carbon fiber reinforced epoxy matrix composites.

14. A process for continuously forming powdered metal particles from a molten mass with a rapidly spinning cup atomizer comprising:

rapidly spinning a cup having an inner wall with an upper lip and without an upper lid;

continuously applying an atomizing fluid to the inner wall of said spinning cup to form a layer or film of the fluid on the inner wall;

supplying molten metal to the interior of the rapidly spinning cup;

directing the supplied molten metal to the layer or film of atomizing fluid on the inner wall of the cup means whereby the atomizing fluid fragments and quenches the molten metal to form on the inner wall a slurry of atomizing fluid and solidified powdered metal;

continuously removing over the top of the lip a portion of the slurry of atomizing fluid and solidified powdered metal from the inner wall of said cup; and recovering the removed slurry of atomizing fluid and solidified powdered metal from the cup.

15. A process according to claim 14, wherein the recovered powdered metal and atomizing fluid are separated.

16. A process according to claim 15, wherein the recovered and separated atomizing fluid is recycled back to the inner wall of the spinning cup.

17. A process according to claim 14, wherein the lip on the cup is inclined upward from the plane constituting the base of the cup at a slope angle $\phi$ which is from about 10–70° and where the slope angle $\phi$ s the angle between the tangent to the inner wall of the cup at the lip and a line perpendicular to the axis of the cup.

18. A process according to claim 17, wherein the slope angle $\phi$ is from about 30–60°.

19. A process according to claim 14, wherein the stream of molten metal is preatomized and broken up into droplets before it reaches the inner wall.

20. A process according to claim 19, wherein the inner wall of the cup has sufficient height to collect the droplets being formed by the preatomization.

21. A process according to claim 19, wherein a mechanical impact atomizer is used to preatomize the stream of molten metal.

22. A process according to claim 19, wherein a gas atomizer is used to preatomize the stream of molten metal.

23. A process according to claim 19, wherein a centrifugal atomizer is used to preatomize the stream of molten metal.

24. A process according to claim 14, wherein as the cup is being accelerated at the beginning of the process or decelerated at the end of the process there is no atomizing fluid supplied to the cup.

25. A process according to claim 14, wherein the cup is made of a high strength material selected from the group consisting of aluminum alloy,titanium alloy, and glass or carbon fiber reinforced epoxy matrix composites.

26. A process according to claim 14, wherein the inner wall of the cup is spinning at a velocity of at least 75 m/sec.

27. A process according to claim 14, wherein the layer or film of the atomizing fluid formed on the inner wall has a thickness of less than about 3 mm.

28. A process according to claim 14, wherein the atomizing fluid is selected from the group consisting of oil, water, kerosene, alcohol, hydrocarbons and mixtures thereof.

29. A process according to claim 14, wherein the atomization process takes place under vacuum or in an inert atmosphere.

30. A process according to claim 14, wherein the inert atmosphere is argon, helium or nitrogen.

31. A rapidly spinning cup molten metal atomizer according to claim 1, including means for continuously discharging the slurry over said upper lip.

32. A rapidly spinning cup molten metal atomizer according to claim 31, wherein said means for continuously discharging the slurry over said upper lip includes angle $\phi$, which is the angle between the tangent to the inner wall of the cup at the lip and a line perpendicular to the axis of the cup, is 10°–70°.

33. A rapidly spinning cup molten metal atomizer according to claim 32, wherein angle $\phi$ of 30°–60°.

34. A rapidly spinning cup molten metal atomizer according to claim 31, wherein said directing means directs the molten metal in the vicinity of said upper lip.

35. A rapidly spinning cup molten metal atomizer according to claim 31, wherein said means for continuously discharging the slurry over said upper lip includes angle $\phi$, which is the angle between the tangent to the inner wall of the cup at the lip and a line perpendicular to the axis of the cup, of 10°–70°.

36. A rapidly spinning cup molten metal atomizer according to claim 35, wherein angle $\phi$ is 30°–60°.

* * * * *

UNITED STATES PATENT AND TRADEMARK OFFICE

CERTIFICATE OF CORRECTION

PATENT NO. : 6,423,113 B1
DATED : July 23, 2003
INVENTOR(S) : Jack Ayers et al.

It is certified that error appears in the above-identified patent and that said Letters Patent is hereby corrected as shown below:

Title page,
Item [*] Notice, delete “964” and insert -- 650 --.

Signed and Sealed this

Twenty-third Day of March, 2004

JON W. DUDAS
*Acting Director of the United States Patent and Trademark Office*